United States Patent [19]

Wood

[11] 4,346,518

[45] Aug. 31, 1982

[54] SHOCK ABSORBER REMOVING TOOL

[76] Inventor: David A. Wood, 9317 Southmoor Dr., Highland, Ind. 46322

[21] Appl. No.: 209,311

[22] Filed: Nov. 21, 1980

[51] Int. Cl.[3] ..... B26B 17/02

[52] U.S. Cl. ..... 30/272 R; 30/190; 29/267

[58] Field of Search ..... 144/193 H, 193 C; 30/272 R, 191, 168, 188, 189, 190, 193; 29/267, 268

[56] References Cited

U.S. PATENT DOCUMENTS

| | | | |
|---|---|---|---|
| 881,538 | 3/1908 | Bienk | 144/193 H |
| 951,016 | 3/1910 | Loock | 30/272 R |
| 1,154,718 | 9/1915 | Neff | 29/268 X |
| 2,666,985 | 1/1954 | Sewell | 30/272 R |
| 3,000,097 | 9/1961 | Hartz | 30/272 R |
| 4,188,722 | 2/1980 | Young | 30/168 |
| 4,203,211 | 5/1980 | Quick | 30/272 R |

*Primary Examiner*—Jimmy C. Peters
*Attorney, Agent, or Firm*—Harvey B. Jacobson

[57] ABSTRACT

A pair of elongated levers are pivotally interconnected at a first pair of corresponding ends for relative oscillation and one of the first ends of the levers includes a lateral projection having a flattened terminus on its free end defining an abutment surface facing toward the opposite end of the corresponding lever. The terminus is provided with a slot therein including an open end opening outwardly of one peripheral portion of the terminus and a closed end generally centered relative to the plan area of the abutment surface. The lever not equipped with the lateral projection includes a laterally projecting bifurcated arm on its first end pivotally attached at its free end to a mounting lug on the first end of the other lever. The base end portion of the bifurcated arm has one end of an elongated thrust member pivotally attached thereto and the other end of the thrust member projections toward and moves toward and away from the slotted abutment surface responsive to movement of the second ends of the levers away and toward each other, respectively. The other end of the thrust member includes an end member defining a pair of longitudinally spaced line segment wedge edges disposed transverse to the longitudinal extent of the thrust member and facing outwardly of the end thereof for engaging and splitting opposite radial portions of a shock absorber attaching nut backed by the slotted abutment surface.

9 Claims, 5 Drawing Figures

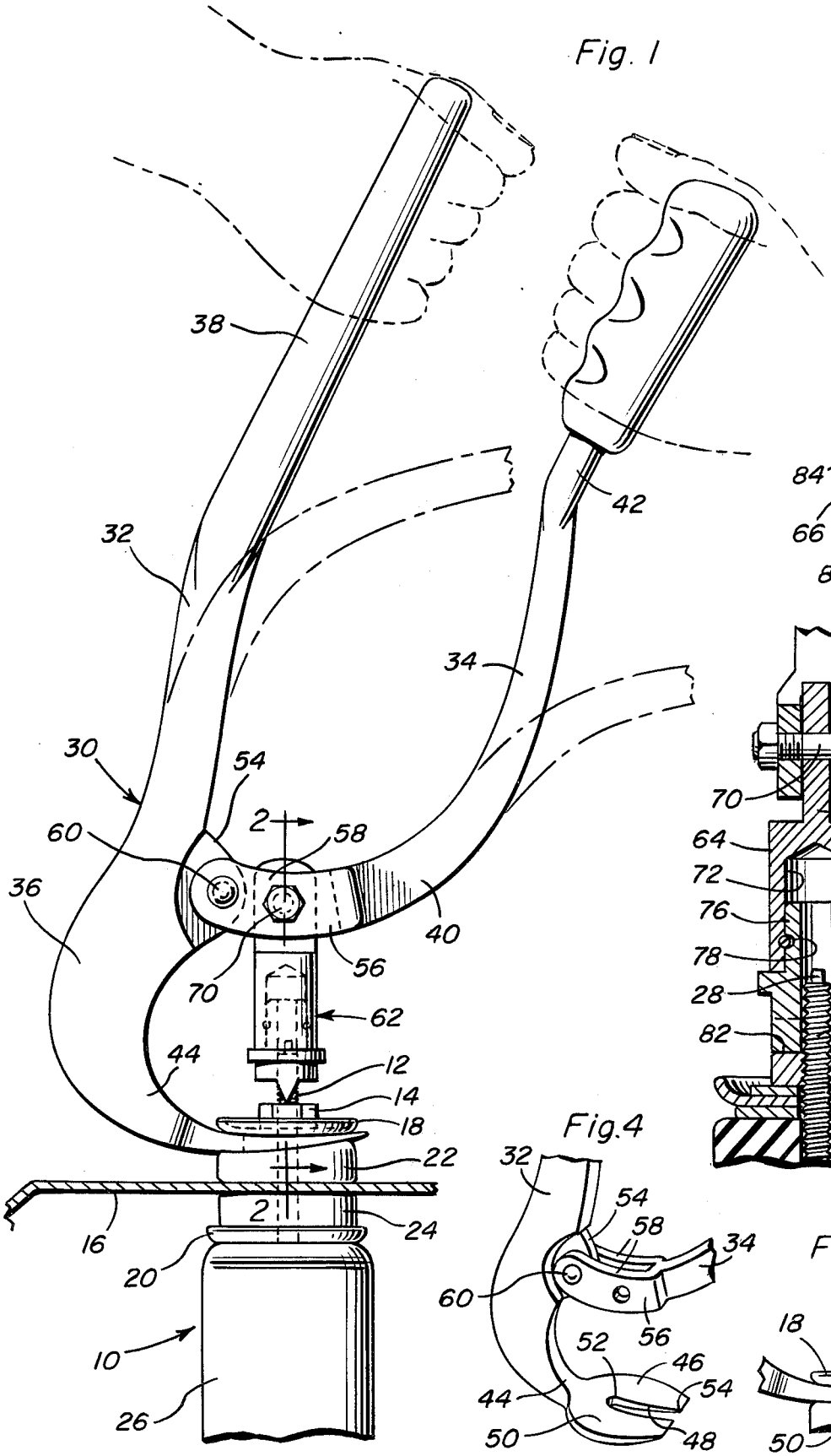
Fig. 1
38
32
42
34
30
54
2
58
60
36
40
56
70
62
44
12
14
18
22
2
24
16
20
10
26
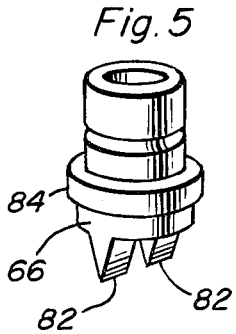
Fig. 5
84
66
82
82
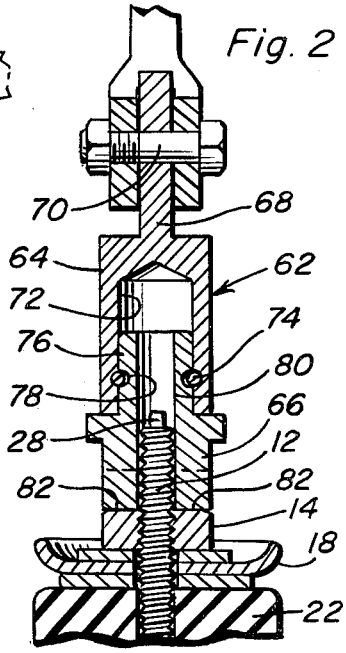
Fig. 2
70
68
64
62
72
74
76
80
78
66
28
12
82
82
14
18
22
Fig. 4
32
54
58
34
60
56
52
46
44
54
50
48
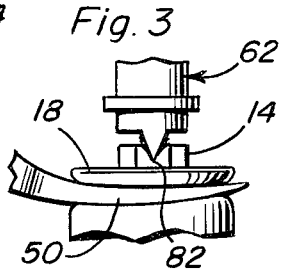
Fig. 3
62
18
14
50
82

SHOCK ABSORBER REMOVING TOOL

BACKGROUND OF THE INVENTION

When replacing automotive shock absorbers equipped with axial attaching nuts, it is sometimes difficult to loosen such attaining nuts inasmuch as the shock absorber piston shank to which they are secured are free to turn relative to the cylinder ends of the shock absorbers. Accordingly, although shock absorber attaching nuts of this type may be positioned to be readily engaged by socket, open-end or box wrenches, such wrenches are sometimes ineffective to loosen the attaching nuts. Accordingly, a need exists for an improved tool by which axial attaching nuts of shock absorbers may be readily split from the piston shanks upon which they are threadedly engaged.

Examples of various forms of nut splitting devices as well as other structures incuding some of the general structural and operational features of the instant invention are disclosed in U.S. Pat. Nos. 881,538, 951,016, 2,666,985, 4,203,211. However, these previously known forms of tools are not readily usable for the express purpose of removing axial shock absorber attaching nuts.

SUMMARY OF THE INVENTION

The tool of the instant invention comprises a pair of pivotally connected levers with one of the levers including a laterally directed and slotted abutment surface and the other lever having an elongated thrust member pivotally attached at one end thereof and including a pair of longitudinally spaced line segment wedge edges disposed transverse to the longitudinal extent of the thrust member at the upper end thereof and facing the abutment surface. Movement of the free ends of the levers apart forces the wedge edges toward the abutment surface and functions to split diametrically opposite radial portions of an attaching nut disposed between the wedge edges and the thrust member.

The main object of this invention is to provide a tool which may be utilized to split shock absorber attaching nuts in order to facilitate replacement of shock absorbers.

Another object of this invention is to provide a shock absorber attaching nut splitting tool which may be utilized to split attaching nuts for shock absorbers to which ready access by other known tools is blocked by surrounding structural components of the associated vehicle.

Another important object of this invention is to provide a tool in accordance with the preceding objects and which may be manually operated.

A final object of this invention to be specifically enumerated herein is to provide a shock absorber attaching nut removing tool which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a side elevational view of the tool in operative association with a shock absorber attaching nut preparatory to removing the nuts;

FIG. 2 is an enlarged, fragmentary, vertical sectional view taken substantially upon the plane indicated by the section line 2—2 of FIG. 1.

FIG. 3 is a fragmentary elevational view illustrating the manner in which a shock absorber attaching nut may be split through utilization of the tool;

FIG. 4 is a fragmentary perspective view of the workpiece engaging end of the tool with the thrust member portion thereof removed; and FIG. 5 is a perspective view of the removable and replaceable head portion of the thrust member.

DETAILED DESCRIPTION OF THE INVENTION

Referring now more specifically to the drawings, the numeral 10 generally designates a conventional form of shock absorber including a threaded mounting shank 12 with which an attaching nut 14 is threadedly engaged for attaching the shock absorber 12 to an automotive body component 16 through the utilization of a pair of abutment washers 18 and 20 and a pair of rubber grommets 22 and 24.

When it is desired to remove the shock absorber 10, the nut 14 must be removed from the shank 12. However, in many instances, the nut 14 is frozen on the shank 12 and the application of a wrench (not shown) on the nut 14 in order to rotate the same results in rotation not only of the nut 14 but also of the shank 12 and the upper shield portion 26 of the shock absorber 10, with the result that loosening of the nut 14 is not accomplished. Although the upper end of the shank 12 is provided with a diametrically reduced non-circular extension 28 with which special tools may be engaged to prevent rotation of the shank 12 when applying torque to the nut 14, there does not always exist proper clearance for utilization of such special tools and the extensions 28 are so small in cross-sectional areas that in many instances the application of special tools thereto may not be effective to maintain the shank 12 stationary while the nut 14 is rotated.

The tool of the instant invention is referred to in general by the reference numeral 30 and includes first and second levers 32 and 34. The lever 32 includes first and second ends 36 and 38 and the second lever includes first and second ends 40 and 42.

The first end 36 of lever 32 includes a laterally projecting terminal end 44 which terminates outwardly in a laterally widened terminus 46 having a slot 48 formed therein. The terminus 46 defines an abutment surface 50 which faces toward the second end of the lever 32 and the slot 48 includes a closed end 52 generally centered relative to the plan area of the abutment surface 50 and an open end 54 which opens outwardly of the free end of the terminal end 44. In addition, the first lever 32 includes an outstanding mounting lug 54 of reduced thickness and the first end 40 of the second lever 34 includes a laterally projecting bifurcated arm 56 whose furcations 58 embracingly receive the lug 54 therebetween and are pivotally anchored thereto by a pivot fastener 60.

An elongated thrust member referred to in general by the reference numeral 62 includes first and second ends 64 and 66 and the first end 64 includes a reduced thickness mounting lug 68 which is pivotally secured between the base ends of the furcations 58 by a pivot fastener 70. The first end 64 includes a blind bore 72 formed therein in which a resilient retaining ring 74 is removably secured and the second end or head 66 includes a mounting shank portion 76 receivable in the bore 72 and provided with a circumferential groove 78 in which the ring 74 is removably seated. The head 66 includes a central bore 80 formed therethrough and the end of the head 66 remote from the shank 76 includes diametrically opposite radially extending wedge edges 82 which face outwardly of the corresponding end of the head 66. The head 66 includes a diametrically enlarged circumferential shoulder 84 which opposes and abuts the end of the first end 64 of the thrust member 62 and the shank 12 has its upper free end upwardly loosely telescoped within the bore 80 when the tool 30 is operatively engaged with the nut 14 in the manner illustrated in FIG. 1.

In operation, the terminus 46 is forced beneath the washer 18 in the manner illustrated in FIG. 1 with the shank 12 seated in the inner end of the slot 48. Then, the head 66 of the thrust member 62 is placed over the upper end of the shank 12 in order that the wedge edges 82 may be engaged with diametrically opposite radially extending portions of the nut 14. Then, the upper or second hand grip defining ends 38 and 42 of the levers 32 and 34 are manually pulled apart resulting in considerable downward axial thrust on the diametrically opposite radially extending areas of the nut 14 with which the wedge edges 82 are engaged. In this manner, the nut 14 is readily split and the shock absorber 10 may be pulled downardly relative to the structural member 16 to effect its removal.

The head 66 is provided as a removable component of the thrust member 62 in order that different heads 66 may be provided for use in conjunction with different size attaching nuts 14. In addition, the head 66 is formed of specially hardened steel and may be removed in order that the edges 82 may be sharpened, if desired.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A shock absorber removing tool comprising first and second elongated levers, one end portion of said first lever including a laterally directed terminal end having a transversely widened terminus defining an abutment surface facing toward the other end of said first lever, said terminus having a slot formed therethrough opening outwardly at one end through a marginal portion of the abutment surface and closed at its other end, the closed end of said slot being generally centered relative to the plan area of said surface, said second elongated lever including a lateral projection at a first end thereof, means pivotally attaching the outer end portion of said projection to said one end portion of said first lever at a point spaced slightly from the terminal end for relative oscillation of said levers about an axis disposed transverse to planes in which said first lever and terminal end and second lever and projection are disposed and for swinging of the other and second ends of said first and second levers, respectively, toward and away from each other, an elongated thrust member pivotally attached at one end to said second lever adjacent the intersection of said projection with said second lever for oscillation relative to said second lever about an axis substantially paralleling the first mentioned axis and with the other end of said thrust member projecting toward said surface and shiftable toward and away from the latter responsive to movement of said other and second ends of said first and second levers away and toward each other, respectively, an end member carried by said other end of said thrust member and defining a pair of longitudinally spaced line segment wedge edges disposed transverse to the longitudinal extent of said thrust member and facing outwardly of said thrust member other end for engaging and splitting opposite radial portions of a shock absorber attaching nut backed by said abutment surface.

2. The combination of claim 1 wherein said wedge edges extend in directions transverse to said slot.

3. The combination of claim 1 wherein said end member is removably supported from said other end of said thrust member.

4. The combination of claim 1 wherein said other end of said thrust member defines an endwise outwardly opening socket, said end member including a mounting shank portion removably received in said socket.

5. The combination of claim 1 wherein said projection comprises a bifurcated arm between the free ends of whose furcations a portion of said first lever is pivotally secured.

6. The combination of claim 5 wherein said one end of said thrust member is pivotally anchored between the base ends of said furcations.

7. The combination of claim 6 wherein said wedge edges extend in directions transverse to said slot.

8. The combination of claim 7 wherein said end member is removably supported from said other end of said thrust member.

9. The combination of claim 8 wherein said other end of said thrust member defines an endwise outwardly opening socket, said end member including a mounting shank portion removably received in said socket.

* * * * *